US012808277B2

(12) United States Patent
Coronado et al.

(10) Patent No.: US 12,808,277 B2
(45) Date of Patent: Nov. 24, 2026

(54) DOWNHOLE TOOL WITH PUMP OUT SEAT

(71) Applicant: The WellBoss Company, LLC, Houston, TX (US)

(72) Inventors: Martin Paul Coronado, Fulshear, TX (US); Bryan Samuel Fitzhugh, Colleyville, TX (US); Timothy Wayne Raley, Hickory, NC (US)

( * ) Notice: Subject to any disclaimer, the term of this patent is extended or adjusted under 35 U.S.C. 154(b) by 0 days.

(21) Appl. No.: 19/197,878

(22) Filed: May 2, 2025

(65) Prior Publication Data

US 2025/0341145 A1 Nov. 6, 2025

Related U.S. Application Data

(60) Provisional application No. 63/642,250, filed on May 3, 2024.

(51) Int. Cl.
*E21B 33/12* (2006.01)

(52) U.S. Cl.
CPC ..... *E21B 33/12* (2013.01)

(58) Field of Classification Search
CPC ..... E21B 33/12
See application file for complete search history.

(56) References Cited

U.S. PATENT DOCUMENTS

| | | | | |
|---|---|---|---|---|
| 4,109,716 | A * | 8/1978 | Canalizo | E21B 23/02 166/191 |
| 9,187,994 | B2 | 11/2015 | Themig | |
| 10,156,122 | B2 | 12/2018 | Nguyen et al. | |
| 10,480,280 | B2 * | 11/2019 | Hou | E21B 33/128 |
| 11,098,556 | B2 | 8/2021 | Frazier | |
| 11,142,991 | B2 * | 10/2021 | Wilcox | E21B 33/134 |
| 11,268,348 | B2 * | 3/2022 | Nordheimer | E21B 43/26 |
| 11,454,081 | B2 | 9/2022 | McFarlin et al. | |
| 11,913,304 | B2 * | 2/2024 | Saraya | E21B 34/063 |
| 11,913,311 | B2 | 2/2024 | Fitzhugh et al. | |
| 2011/0180274 | A1 * | 7/2011 | Wang | E21B 34/14 166/386 |
| 2016/0333660 | A1 * | 11/2016 | Dedman | E21B 33/1208 |
| 2019/0323314 | A1 * | 10/2019 | Hughes | E21B 33/1285 |
| 2020/0115988 | A1 * | 4/2020 | Wilcox | E21B 23/06 |
| 2021/0047895 | A1 * | 2/2021 | Sherman | E21B 29/02 |
| 2021/0404300 | A1 * | 12/2021 | Fitzhugh | E21B 33/1292 |
| 2022/0136360 | A1 | 5/2022 | Buckland | |
| 2022/0205333 | A1 * | 6/2022 | Mcfarlin | E21B 33/124 |

* cited by examiner

*Primary Examiner* — Steven A Macdonald
(74) *Attorney, Agent, or Firm* — Kearney, Mc Williams & Davis, PLLC; John M. DeBoer

(57) ABSTRACT

A downhole tool having a mandrel. The mandrel includes a proximate end; a distal end; a bore having a respective seat associated therewith; and an outer surface. The pump out seat assembly is movably disposed within the bore. The pump out seat is movable between a first position and an other position. In the first position the pump out seat prevents flow through the bore. In the other position the pump out seat does not prevent flow through the bore.

19 Claims, 8 Drawing Sheets

200

202

DOWNHOLE TOOL WITH PUMP OUT SEAT

STATEMENT REGARDING FEDERALLY SPONSORED RESEARCH OR DEVELOPMENT

Not applicable.

BACKGROUND

Field of the Disclosure

This disclosure generally relates to tools used in oil and gas wellbores. More specifically, the disclosure relates to downhole tools that may be run into a wellbore and useable for wellbore isolation, and systems and methods pertaining to the same. In embodiments, the tool may have a pump out seat or shuttle therein.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs is typically has low permeability, and it is uneconomical to produce the hydrocarbons (i.e., gas, oil, etc.) in commercial quantities from this formation without the use of drilling accompanied with fracing operations.

Fracing is now common in the industry, and has reshaped the global energy sector. and includes the use of a plug set in the wellbore below or beyond the respective target zone, followed by pumping or injecting high pressure frac fluid into the zone. A frac plug and accompanying operation may be such as described or otherwise disclosed in U.S. Pat. No. 8,955,605, incorporated by reference herein in its entirety for all purposes.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 105 (e.g., e-line, wireline, coiled tubing, etc.) and/or with setting tool 112, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

Upon proper setting, the plug may be subjected to high or extreme pressure and temperature conditions, which means the plug must be capable of withstanding these conditions without destruction of the plug or the seal formed by the seal element. High temperatures are generally defined as downhole temperatures above 200° F., and high pressures are generally defined as downhole pressures above 7,500 psi, and even in excess of 15,000 psi. Extreme wellbore conditions may also include high and low pH environments.

Downhole tools may have a seat for receiving a drop ball or other obstruction device (such as a shuttle), which may be 'in place' during run in (i.e., the ball or device is with the tool during run-in). When the tool is set and the drop ball engages the seat, the casing or other tubular in which the tool is set is sealed. Fluid may be pumped into the well after the drop ball engages the seat and forced into a formation above the tool. Prior to the seating of the ball, however, flow through the tool is allowed.

Another way to seal the tool is to drop a ball from the surface after the tool is set. Although the ball may ultimately reach the ball seat to perform its desired function, it takes time for the ball to reach the ball seat, and as the ball is pumped downward a substantial amount of fluid can be lost. Fluid loss and lost time to get the ball seated can still be a problem, however, especially in deviated or horizontal wells.

When the flow path in the tool is obstructed, there is some concern over pressure imbalance through the tool, to the point that it may be desirous to equalize by removing the obstruction from the seat. This is especially the case with pressurized zones below the location of the set plug. But removal of the obstruction to equalize pressure may result in an inadequate flow path or inadvertent obstruction elsewhere in the tool, whereby any subsequent pumpdown will be ineffective.

During plug-and-perf fracturing operations, there is an issue if the perforating guns for a certain stage do not fire and create flow paths into the formation above the previously set frac plug. This creates an issue of not having a flow path for the fluid when pumping a new set of guns into a horizontal well, which require a flow down the casing string for the surface to transport the guns into the horizontal section of the wellbore. Since the previously-set frac plug hold pressure from above, there is no flow path for the fluid into the well if no perforations have been created.

Previously, in such a scenario the well would have to be flowed in the production direction to flow the obstruction device in the frac plug to surface, thus creating a flow path through the frac plug to the lower zones, the frac plug would have to be removed via a well intervention, or a new set of guns would have to be tractored into the well via wireline. All of these options are time consuming, resulting in non-production operational time. There are other times where the flow path through the tool might be too restricted.

There is a need in the art for a downhole tool that may provide a flow path through the downhole tool on-demand, as needed or warranted. There is a need in the art to remove a plug or other obstruction from the downhole tool in a manner that ensure the plug/obstruction does not re-seat. If the guns fire successfully, then the plug functions as a normal frac plug with no operational difference. There is a need in the art to prevent inadvertent obstruction or other problems caused by objects proximate to a set tool.

The ability to save operational time (and those saving operational costs) leads to considerable competition in the marketplace. Achieving any ability to save time, or ultimately cost, leads to an immediate competitive advantage, so the Applicant continues to progress the art by addressing needs where they exist.

SUMMARY

Embodiments of the disclosure pertain to a method of using a downhole tool that may include one or more steps of: at a surface facility proximate to a wellbore, connecting the downhole tool with a workstring; operating the workstring to run the downhole tool into the wellbore to a desired position; setting the downhole tool; and disconnecting the downhole tool from the workstring.

Embodiments of the disclosure pertain to a pump out seat assembly for a downhole tool that may include a pump out or movable ball seat. The downhole tool may be a frac plug. The seat may be weighted.

Other embodiments of the disclosure pertain to a downhole tool having a mandrel and a pump out seat. The mandrel may have a bore and a respective seat formed on an inner bore surface thereof. The pump out seat may be disposed within the bore, such as in a first or run-in position. The pump out seat may be movable between a first position and an other position, which may be a second position, a third position, etc. A particular position may coincide to pressure down or sheared position. In an analogous manner, the other position may coincide to a dislodged position.

In the run-in or the first position, the pump out seat need not be engaged on the respective seat. As such, the pump out seat may be releasably secured in the first position.

The pump out seat may include at least one wedge tip. In aspects, the downhole tool may have a central axis and the wedge tip may have a tip axis. In the first position the central axis and the tip axis may be parallel to each other. The two axes may also be offset.

For any embodiment herein the downhole tool may be a frac plug or other suitable pressure isolation device. For any embodiment herein an at least one component of the downhole tool may be made of a reactive material. The reactive material may be that for which a surrounding (wellbore) fluid may be known to cause a reaction of the material in a shorter or predetermined amount of time (whereas other materials may be non-reactive or inert to normal wellbore conditions).

The pump out seat may include a seal member disposed thereon. In the first position, the seal member may be sealingly engaged with the inner bore surface thus preventing flow through the bore. In another position, such as a second, a third, etc. the seal member may no longer be engaged with the inner bore surface thereby facilitating fluid flow through the bore. Thus, the pump out seat may provide a fluid bypass capability, while still being retained within the downhole tool (or its bore). The pump out seat may be a translated or movable seat, while yet retained within the bore.

The pump out seat may have a main body having first end, and a second end. The second end may be configured with a tip extending therefrom. The tip is not limited to any particular shape. The tip may be wedge shape, with one or more converging portions or surfaces (such as width, thickness, etc.).

The pump out seat may be movable, such as from the first position to a second position. The second position need not be limited, and may be a range of positions. The second position may be or include a shoulder surface of the pump out seat engaged with the respective seat of the bore.

For any embodiment of the disclosure, the breaking or shearing of a retainer member may allow or facilitate the pump out seat to move to the second position.

Yet other embodiments herein may pertain to a downhole tool that may have a mandrel configured with a bore and a respective seat formed on an inner bore surface. In a first or run-in position, there may be a pump out seat disposed within the bore.

The pump out seat may include a seal member configured to engage with the inner bore surface, such as in the first position.

For any embodiment herein the first position may include the pump out seat not engaged on a respective seat. The first position may include the seal member (sealingly) engaged with the inner bore surface, which may thus prevent any flow of fluid through the bore.

For any embodiment herein, another or the second position may include the seal member no longer engaged with the inner bore surface thereby no longer preventing fluid flow through the bore. As such, the pump out seat may provide a fluid by-pass configuration, while still disposed within the bore.

For any embodiment herein another position, such as the third position, may include the pump out seat dislodged from the bore.

Embodiments herein pertain to a downhole tool that may have a mandrel configured with a pump out seat assembly. The assembly may include a pump out seat. The pump out seat may be movable between a first position and a second position. The pump out seat may have a third position. The third position may include the seat dislodged or otherwise disengaged from the downhole tool flow bore. The first position may be a run-in position. The second position may be an intermediate position, such as an equalizing position or a shear down (frac) position. The pump out seat assembly may be movable within the downhole tool to provide fluid bypass, but still remains engaged within the downhole tool.

At least one component of the downhole tool and/or pump out seat assembly may be made of a reactive material.

Any embodiment herein may include an associated method, system, etc. related to the use and operation of the pump out seat.

These and other embodiments, features and advantages will be apparent in the following detailed description and drawings.

BRIEF DESCRIPTION OF THE DRAWINGS

For a more detailed description of the present invention, reference will now be made to the accompanying drawings, wherein.

DETAILED DESCRIPTION

Figure 1:
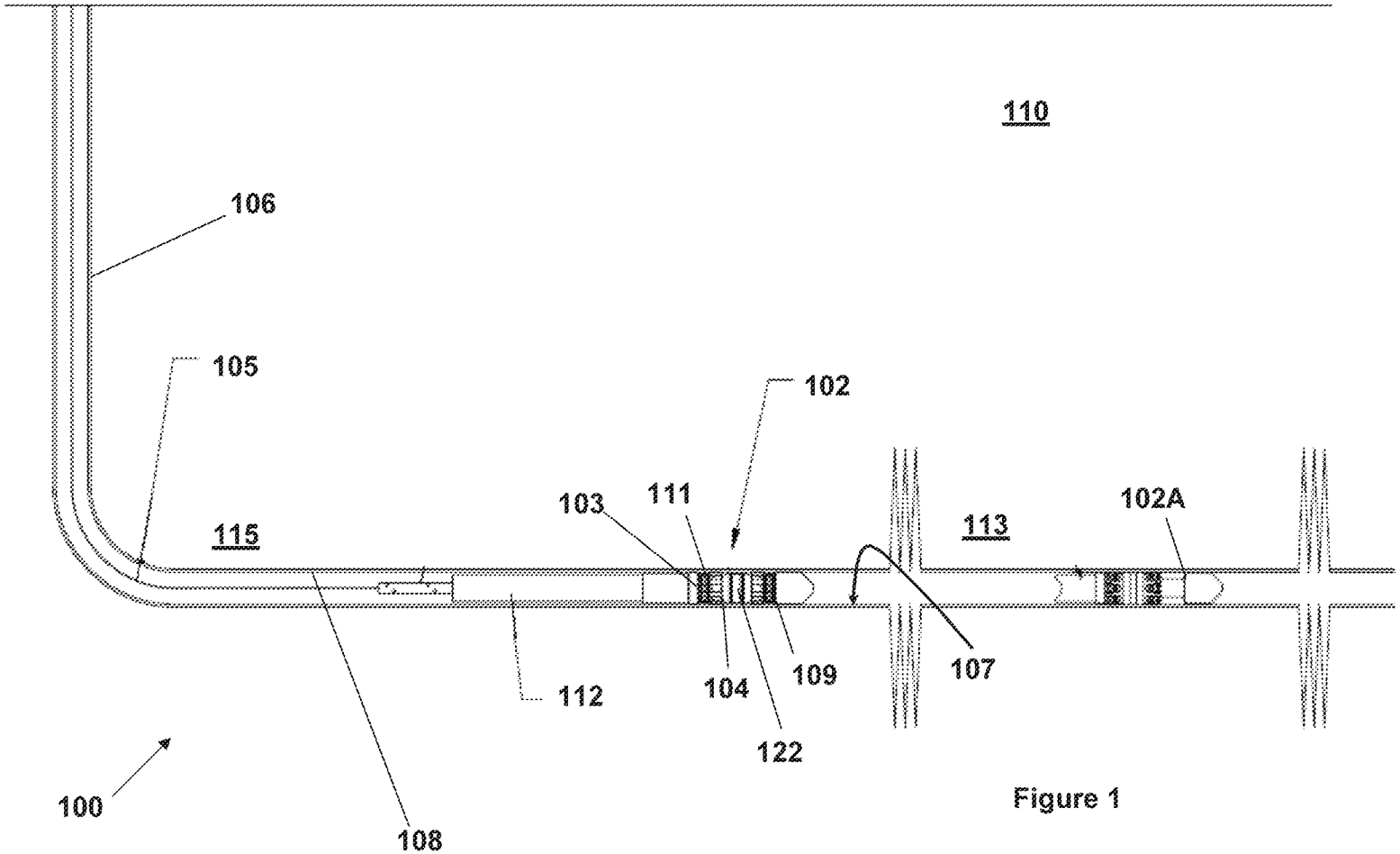
FIG. 1 is a side view of a process diagram of a conventional plugging system.

Herein disclosed are novel apparatuses, systems, and methods that pertain to downhole tools usable for wellbore operations, details of which are described herein.

Downhole tools according to embodiments disclosed herein may include one or more anchor slips, one or more compression cones engageable with the slips, and a compressible seal element disposed therebetween, all of which may be configured or disposed around a mandrel. The mandrel may include a flow bore open to an end of the tool and extending to an opposite end of the tool. In embodiments, the downhole tool may be a frac plug or a bridge plug. Thus, the downhole tool may be suitable for frac operations. In an exemplary embodiment, the downhole tool may be a composite frac plug made of drillable material, the plug being suitable for use in vertical or horizontal wellbores.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure.

Terms

Composition of matter: as used herein may refer to one or more ingredients or constituents that make up a material (or material of construction). For example, a material may have a composition of matter. Similarly, a device may be made of a material having a composition of matter. The composition of matter may be derived from an initial composition.

Reactive Material: as used herein may refer a material with a composition of matter having properties and/or characteristics that result in the material responding to a change over time and/or under certain conditions. The term reactive material may encompass degradable, dissolvable, disassociatable, and so on.

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "fracing" as used herein can refer to fractionation of a downhole well that has already been drilled. 'Fracing' can also be referred to and interchangeable with the terms facing operation, fractionation, hydrofracturing, hydrofracking, fracking, frac, and so on. A frac operation can be land or water based.

The term "pump out" as used herein may refer to the act of, or an ability to, move. For example, a pump out seat move or translate from a first or original position to a second or destination position. There may be a maximum range of travel between the first position and the second position.

There may be any number of intermediate positions. The second position may be one of the intermediate positions. The destination or final position may include the pump out seat dislodged or removed from the downhole tool.

Embodiments herein provide for a pump out or movable seat assembly that may be within a downhole tool during run in. If a downhole operation (such as a perforating tool) goes properly, the downhole operation may continue as normal. If the operation has a problem, the well may be flowed back, which causes the assembly (or a component thereof) to shift upwards or otherwise dislodge.

With the assembly or other obstruction out of a tool seat, a bore or flowpath of the downhole tool may now be open to flow from the surface. Flow from the surface may subsequently cause the seat assembly to hook or otherwise catch on the outside of the tool, but not otherwise re-seat. The seat assembly may be weighted or provided with an imbalance to facilitate staying out of the downhole tool.

Figure 2A:
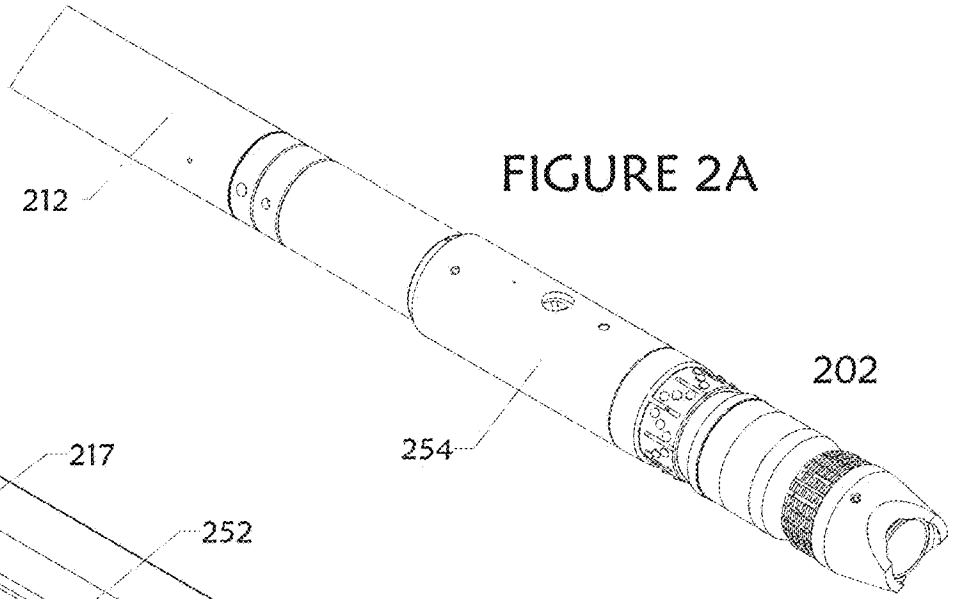
FIG. 2A shows an isometric view of a system having a downhole tool, according to embodiments of the disclosure.
Figure 2B:
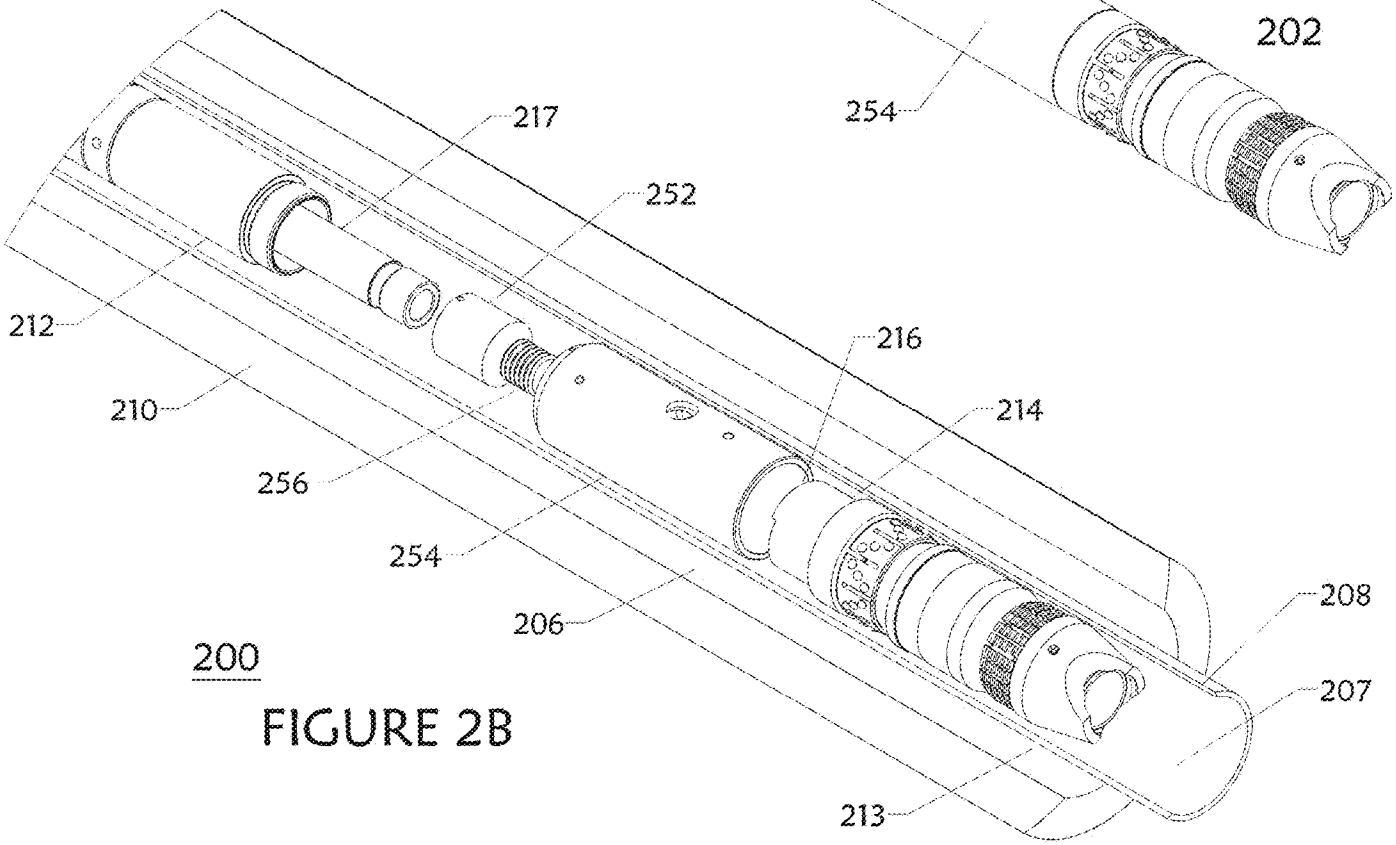
FIG. 2B shows an isometric view of a system having a downhole tool, according to embodiments of the disclosure.

Referring now to FIGS. 2A and 2B together, isometric views of a system 200 having a downhole tool 202 illustrative of embodiments disclosed herein, are shown. FIG. 2B depicts a wellbore 206 formed in a subterranean formation 210 with a tubular 208 disposed therein. In an embodiment, the tubular 208 may be casing (e.g., casing, hung casing, casing string, etc.) (which may be cemented). A workstring 212 (which may include a part 217 of a setting tool coupled with adapter 252) may be used to position or run the downhole tool 202 into and through the wellbore 206 to a desired location.

In accordance with embodiments of the disclosure, the tool 202 may be configured as a plugging tool, which may be set within the tubular 208 in such a manner that the tool 202 forms a fluid-tight seal against the inner surface 207 of the tubular 208. In an embodiment, the downhole tool 202 may be configured as a bridge plug, whereby flow from one section of the wellbore 213 to another (e.g., above and below the tool 202) is controlled. In other embodiments, the downhole tool 202 may be configured as a frac plug, where flow into one section 213 of the wellbore 206 may be blocked and otherwise diverted into the surrounding formation or reservoir 210.

In yet other embodiments, the downhole tool 202 may also be configured as a ball drop tool. In this aspect, a ball may be dropped into the wellbore 206 and flowed into the tool 202 and come to rest in a corresponding ball seat at the end of the mandrel 214. The seating of the ball may provide a seal within the tool 202 resulting in a plugged condition, whereby a pressure differential across the tool 202 may result. The ball seat may include a radius or curvature.

In other embodiments, the downhole tool 202 may be a ball check plug, whereby the tool 202 is configured with a ball already in place when the tool 202 runs into the wellbore. The tool 202 may then act as a check valve, and provide one-way flow capability. Fluid may be directed from the wellbore 206 to the formation with any of these configurations. One of skill would appreciate that another form of an obstruction device may be used in lieu of a ball. For example, a shuttle or other form of movable seat.

Once the tool 202 reaches the set position within the tubular, the setting mechanism or workstring 212 may be detached from the tool 202 by various methods, resulting in the tool 202 left in the surrounding tubular and one or more sections of the wellbore isolated. In an embodiment, once the tool 202 is set, tension may be applied to the adapter 252 until the threaded connection between the adapter 252 and the mandrel 214 is broken. For example, the mating threads on the adapter 252 and the mandrel 214 (256 and 216, respectively as shown in FIG. 2D) may be designed to shear, and thus may be pulled and sheared accordingly in a manner known in the art. The amount of load applied to the adapter 252 may be in the range of about, for example, 20,000 to 40,000 pounds force. In other applications, the load may be in the range of less than about 10,000 pounds force.

Accordingly, the adapter 252 may separate or detach from the mandrel 214, resulting in the workstring 212 being able to separate from the tool 202, which may be at a predetermined moment. The loads provided herein are non-limiting and are merely exemplary. The setting force may be determined by specifically designing the interacting surfaces of the tool and the respective tool surface angles. The tool may 202 also be configured with a predetermined failure point (not shown) configured to fail or break. For example, the failure point may break at a predetermined axial force greater than the force required to set the tool but less than the force required to part the body of the tool.

Operation of the downhole tool 202 may allow for fast run in of the tool 202 to isolate one or more sections of the wellbore 206, as well as quick and simple drill-through to destroy or remove the tool 202. Drill-through of the tool 202 may be facilitated by components and sub-components of tool 202 made of drillable material that is less damaging to a drill bit than those found in conventional plugs.

The downhole tool 202 may have one or more components made of a material as described herein and in accordance with embodiments of the disclosure. In an embodiment, the downhole tool 202 and/or its components may be a drillable tool made from drillable composite material(s), such as glass fiber/epoxy, carbon fiber/epoxy, glass fiber/PEEK, carbon fiber/PEEK, etc. Other resins may include phenolic, polyamide, etc. All mating surfaces of the downhole tool 202 may be configured with an angle, such that corresponding components may be placed under compression instead of shear.

The downhole tool 202 may have one or more components made of non-composite material, such as a metal or metal alloys. The downhole tool 202 may have one or more components made of a reactive material (e.g., dissolvable, degradable, etc.).

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. In embodiments, the components of the tool 202 may be made of dissolvable aluminum-, magnesium-, or aluminum-magnesium-based (or alloy, complex, etc.) material.

One or more components of tool 202 may be made of non-dissolvable materials (e.g., materials suitable for and are known to withstand downhole environments [including extreme pressure, temperature, fluid properties, etc.] for an extended period of time (predetermined or otherwise) as may be desired).

Just the same, one or more components of a tool of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 3 to about 48 hours after setting of the downhole tool 202.

The downhole tool 202 (and other tool embodiments disclosed herein) and/or one or more of its components may be 3D printed as would be apparent to one of skill in the art, such as via one or more known methods or processes.

Figure 2C:
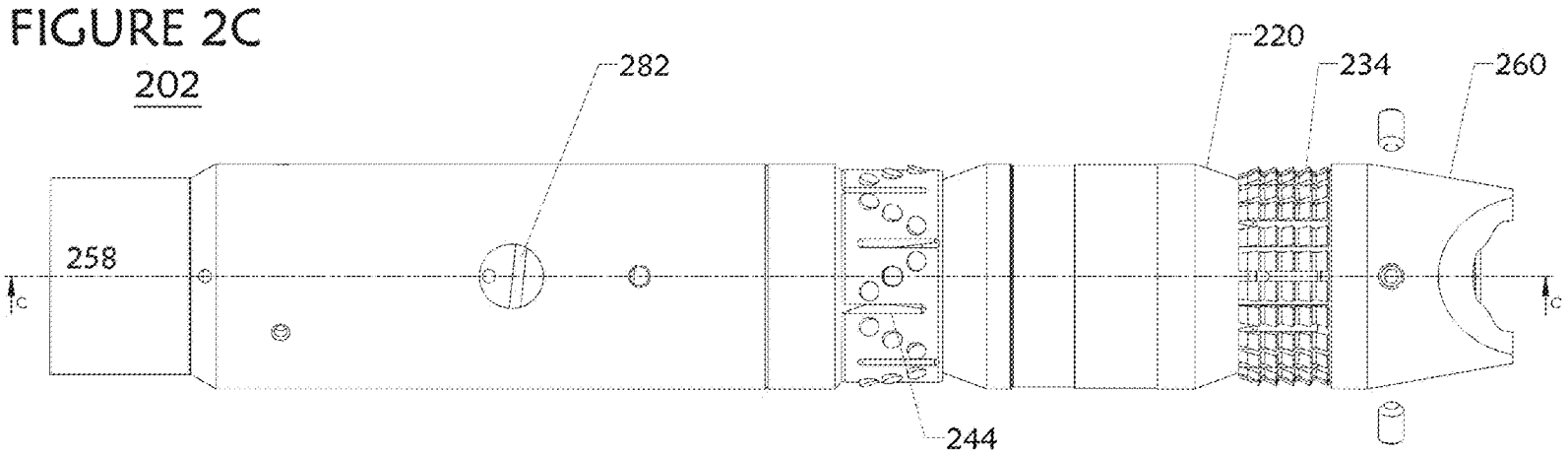
FIG. 2C shows a side longitudinal view of a downhole tool according to embodiments of the disclosure.
Figure 2D:
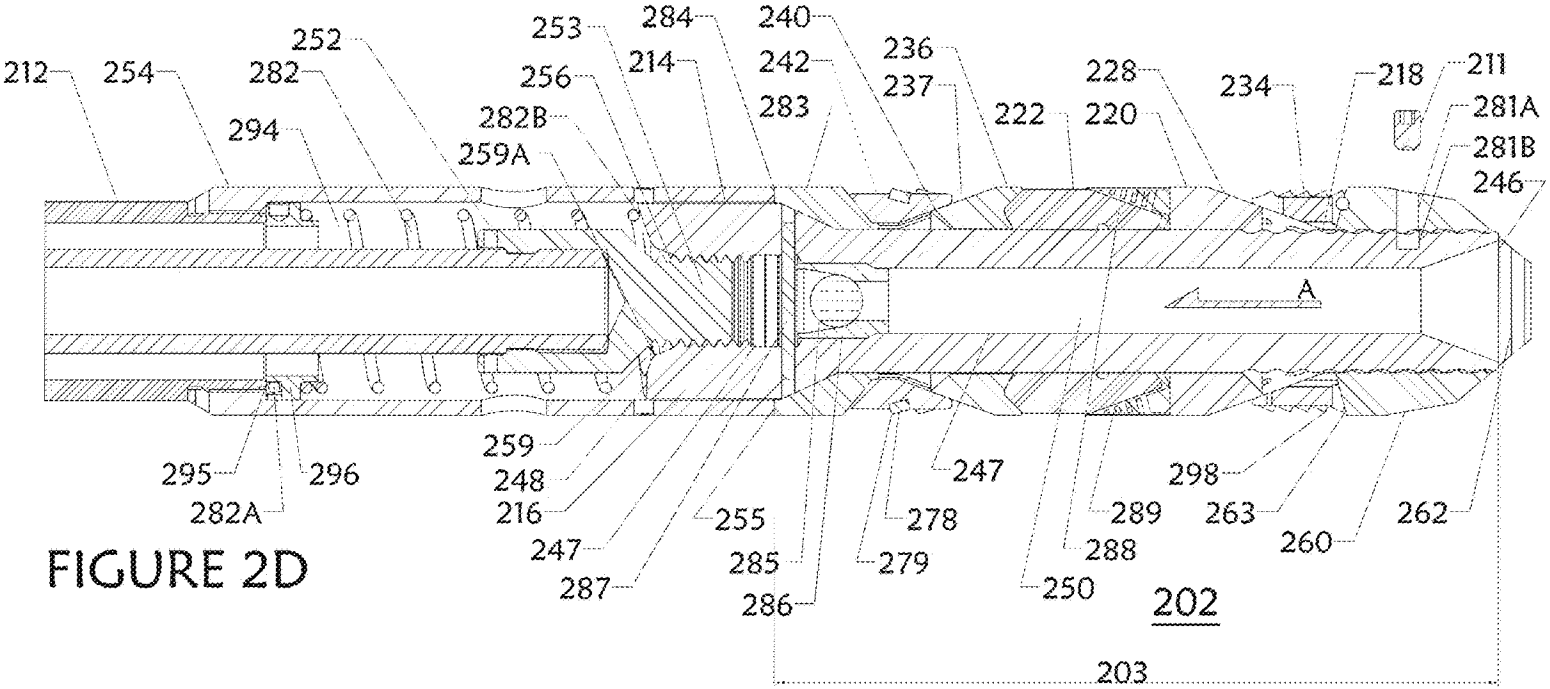
FIG. 2D shows a longitudinal cross-sectional view of a downhole tool according to embodiments of the disclosure.
Figure 2E:
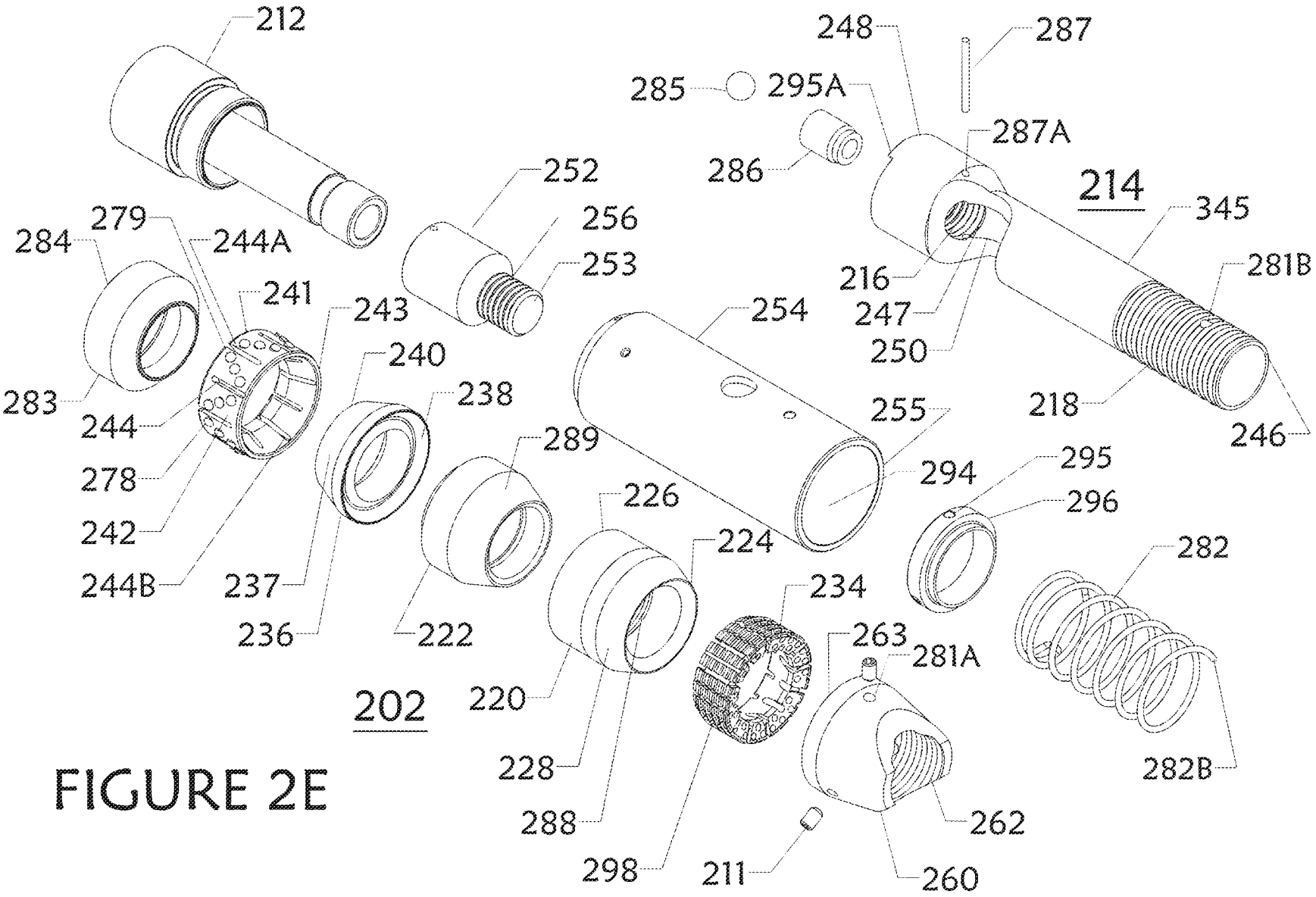
FIG. 2E shows an isometric component break-out view of a downhole tool according to embodiments of the disclosure.

Referring now to FIGS. 2C-2E together, a longitudinal view, a longitudinal cross-sectional view, and an isometric component break-out view, respectively, of downhole tool 202 useable with system (200, FIG. 2A) and illustrative of embodiments disclosed herein, are shown. The downhole tool 202 may include a mandrel 214 that extends through the tool (or tool body) 202. The mandrel 214 may be a solid body. In other aspects, the mandrel 214 may include a flowpath or bore 250 formed therein (e.g., an axial bore). The bore 250 may extend partially or for a short distance through the mandrel 214, as shown in FIG. 2E. Alternatively, the bore 250 may extend through the entire mandrel 214, with an opening at its proximate end 248 and oppositely at its distal end 246 (near downhole end of the tool 202), as illustrated by FIG. 2D.

The presence of the bore 250 or other flowpath through the mandrel 214 may indirectly be dictated by operating conditions. That is, in most instances the tool 202 may be large enough in diameter (e.g., 4¾ inches) that the bore 250 may be correspondingly large enough (e.g., 1¼ inches) so that debris and junk can pass or flow through the bore 250 without plugging concerns. However, with the use of a smaller diameter tool 202, the size of the bore 250 may need to be correspondingly smaller, which may result in the tool 202 being prone to plugging. Accordingly, the mandrel may be made solid to alleviate the potential of plugging within the tool 202.

With the presence of the bore 250, the mandrel 214 may have an inner bore surface 247, which may include one or more threaded surfaces formed thereon. As such, there may be a first set of threads 216 configured for coupling the mandrel 214 with corresponding threads 256 of a setting adapter 252.

The coupling of the threads, which may be shear threads, may facilitate detachable connection of the tool 202 and the setting adapter 252 and/or workstring (212, FIG. 2B) at the threads. It is within the scope of the disclosure that the tool 202 may also have one or more predetermined failure points (not shown) configured to fail or break separately from any threaded connection. The failure point may fail or shear at a predetermined axial force greater than the force required to set the tool 202.

The adapter 252 may include a stud 253 configured with the threads 256 thereon. In an embodiment, the stud 253 has external (male) threads 256 and the mandrel 214 has internal (female) threads; however, type or configuration of threads is not meant to be limited, and could be, for example, a vice versa female-male connection, respectively.

The downhole tool 202 may be run into wellbore (206, FIG. 2A) to a desired depth or position by way of the workstring (212, FIG. 2A) that may be configured with the setting device or mechanism. The workstring 212 and setting sleeve 254 may be part of the plugging tool system 200 utilized to run the downhole tool 202 into the wellbore, and activate the tool 202 to move from an unset to set position. The set position may include seal element 222 and/or slips 234, 242 engaged with the tubular (208, FIG. 2B). In an embodiment, the setting sleeve 254 (that may be configured as part of the setting mechanism or workstring) may be utilized to force or urge compression of the seal element 222, as well as swelling of the seal element 222 into sealing engagement with the surrounding tubular.

The setting device(s) and components of the downhole tool 202 may be coupled with, and axially and/or longitudinally movable along mandrel 214. When the setting sequence begins, the mandrel 214 may be pulled into tension while the setting sleeve 254 remains stationary. The lower sleeve 260 may be pulled as well because of its attachment to the mandrel 214 by virtue of the coupling of threads 218 and threads 262. As shown in the embodiment of FIGS. 2C and 2D, the lower sleeve 260 and the mandrel 214 may have matched or aligned holes 281A and 281B, respectively, whereby one or more anchor pins 211 or the like may be disposed or securely positioned therein. In embodiments, brass set screws may be used. Pins (or screws, etc.) 211 may prevent shearing or spin-off during drilling or run-in.

As the lower sleeve 260 is pulled in the direction of Arrow A, the components disposed about mandrel 214 between the lower sleeve 260 and the setting sleeve 254 may begin to compress against one another. This force and resultant movement causes compression and expansion of seal element 222. The lower sleeve 260 may also have an angled sleeve end 263 in engagement with the slip 234, and as the lower sleeve 260 is pulled further in the direction of Arrow A, the end 263 compresses against the slip 234. As a result, slip(s) 234 may move along a tapered or angled surface 228 of a composite member 220, and eventually radially outward into engagement with the surrounding tubular (208, FIG. 2B).

Serrated outer surfaces or teeth 298 of the slip(s) 234 may be configured such that the surfaces 298 prevent the slip 234 (or tool) from moving (e.g., axially or longitudinally) within the surrounding tubular, whereas otherwise the tool 202 may inadvertently release or move from its position. Although slip 234 is illustrated with teeth 298, it is within the scope of the disclosure that slip 234 may be configured with other gripping features, such as buttons or inserts.

Initially, the seal element 222 may swell into contact with the tubular, followed by further tension in the tool 202 that may result in the seal element 222 and composite member 220 being compressed together, such that surface 289 acts on the interior surface 288. The ability to "flower", unwind, and/or expand may allow the composite member 220 to extend completely into engagement with the inner surface of the surrounding tubular.

Additional tension or load may be applied to the tool 202 that results in movement of cone 236, which may be disposed around the mandrel 214 in a manner with at least one surface 237 angled (or sloped, tapered, etc.) inwardly of second slip 242. The second slip 242 may reside adjacent or proximate to collar or cone 236. As such, the seal element 222 forces the cone 236 against the slip 242, moving the slip 242 radially outwardly into contact or gripping engagement with the tubular. Accordingly, the one or more slips 234, 242 may be urged radially outward and into engagement with the tubular (208, FIG. 2B). In an embodiment, cone 236 may be slidingly engaged and disposed around the mandrel 214. As shown, the first slip 234 may be at or near distal end 246, and the second slip 242 may be disposed around the mandrel 214 at or near the proximate end 248. It is within the scope of the disclosure that the position of the slips 234 and 242 may be interchanged. Moreover, slip 234 may be interchanged with a slip comparable to slip 242, and vice versa.

Because the sleeve 254 is held rigidly in place, the sleeve 254 may engage against a bearing plate 283 that may result in the transfer load through the rest of the tool 202. The setting sleeve 254 may have a sleeve end 255 that abuts against the bearing plate end 284. As tension increases through the tool 202, an end of the cone 236, such as second end 240, compresses against slip 242, which may be held in place by the bearing plate 283. As a result of cone 236 having freedom of movement and its conical surface 237, the cone 236 may move to the underside beneath the slip 242, forcing the slip 242 outward and into engagement with the surrounding tubular (208, FIG. 2B).

The second slip 242 may include one or more, gripping elements, such as buttons or inserts 278, which may be configured to provide additional grip with the tubular. The inserts 278 may have an edge or corner 279 suitable to provide additional bite into the tubular surface. In an embodiment, the inserts 278 may be mild steel, such as 1018 heat treated steel. The use of mild steel may result in reduced or eliminated casing damage from slip engagement and reduced drill string and equipment damage from abrasion.

In an embodiment, slip 242 may be a one-piece slip, whereby the slip 242 has at least partial connectivity across its entire circumference. Meaning, while the slip 242 itself may have one or more grooves (or undulation, notch, etc.) 244 configured therein, the slip 242 itself has no initial circumferential separation point. In an embodiment, the grooves 244 may be equidistantly spaced or disposed in the second slip 242. In other embodiments, the grooves 244 may have an alternatingly arranged configuration. That is, one groove 244A may be proximate to slip end 241, the next groove 244B may be proximate to an opposite slip end 243, and so forth.

The tool 202 may be configured with or to receive a ball or other form of obstruction 285. The ball or obstruction 285 may be configured to engage and disengage with a seat 286. In embodiments, the seat 286 may be integrally formed within the bore 250 of the mandrel 214. The seat 286 may be configured in a manner so that the obstruction 285 may seat or rests therein, whereby the flowpath through the mandrel 214 may be closed off (e.g., flow through the bore 250 is restricted or controlled by the presence of the obstruction 285).

For example, fluid flow from one direction may urge and hold the obstruction 285 against the seat 286, whereas fluid flow from the opposite direction may urge the obstruction 285 off or away from the seat 286. The obstruction 285 may be made of a durable material, such as metal or composite. The obstruction 285 may be conventionally made of a composite material, phenolic resin, etc., whereby the obstruction 285 may be capable of holding maximum pressures experienced during downhole operations (e.g., fracing). The obstruction 285 may be like that of pump out seat 385 shown in FIGS. 4A-4B, 5A-5B, etc.

The tool 202 may include an anti-rotation assembly that includes an anti-rotation device or mechanism 282, which may be a spring, a mechanically spring-energized composite tubular member, and so forth. The device 282 may be configured and usable for the prevention of undesired or inadvertent movement or unwinding of the tool 202 components. As shown, the device 282 may reside in cavity 294 of the sleeve (or housing) 254. During assembly the device 282 may be held in place with the use of a lock ring 296. In other aspects, pins may be used to hold the device 282 in place.

FIG. 2D shows the lock ring 296 may be disposed around a part 217 of a setting tool coupled with the workstring 212. The lock ring 296 may be securely held in place with screws inserted through the sleeve 254. The lock ring 296 may include a guide hole or groove 295, whereby an end 282A of the device 282 may slidingly engage therewith. Protrusions or dogs 295A may be configured such that during assembly, the mandrel 214 and respective tool components may ratchet and rotate in one direction against the device 282; however, the engagement of the protrusions 295A with device end 282B may prevent back-up or loosening in the opposite direction.

Drill-through of the tool 202 may be facilitated by the fact that the mandrel 214, the slips 234, 242, the cone(s) 236, the composite member 220, etc. may be made of drillable material that is less damaging to a drill bit than those found in conventional plugs. The drill bit will continue to move through the tool 202 until the downhole slip 234 and/or 242 are drilled sufficiently that such slip loses its engagement with the well bore. When that occurs, the remainder of the tools, which generally would include lower sleeve 260 and any portion of mandrel 214 within the lower sleeve 260 falls into the well. The tool 202 may include a movable (translating, pump out, etc.) seat assembly as set forth herein.

Referring now to FIGS. 3A, 3B, 3C and 3D together, a longitudinal side cross-sectional view of a mandrel end configured with a movable seat in a first position usable with a downhole tool, a longitudinal side cross-sectional view of the movable seat in a second position, a longitudinal side cross-sectional view of the movable seat in another or intermediate position, a longitudinal cross-sectional view of the moveable seat in third or dislodged position, respectively, in accordance with embodiments disclosed herein, are shown.

The downhole tool 302 may be any type of downhole tool to which an in-bore obstruction may be useful, such as a frac plug. The downhole tool 302 may be run, set, and operated as described herein and in other embodiments (such as in System 200, and so forth), and as otherwise understood to one of skill in the art.

Although not meant to be limited, the downhole tool 302 may be comparable or identical in aspects, function, operation, components, etc. as that of other tool embodiments disclosed herein. Components of the downhole tool 302 (shown only here in part) may be arranged and disposed about a mandrel 314 (see, e.g., FIGS. 2A-2E). The downhole tool 302 may be operatively connected with a workstring 312 (shown in simplified schematic box form), as shown in the first or run-in position of FIG. 3A. Further information about the workstring 312 may be gleaned, for example, from FIGS. 2B-2D and accompanying text, or as would otherwise may be apparent to one of skill in the art.

Although not shown in detail here, the workstring 312 may have a setting tool coupled with the downhole tool 302. As such, the downhole tool 302 may be put in a set position as shown in FIG. 3B-3D. The set position may include a sealing element 322 and/or one or more slips engaged with an inner surface 307 of a surrounding tubular (such as casing) 308.

The mandrel 314, which may be made from any type of non-limiting material, such as filament wound drillable material, may have a distal end (not viewable here) and a proximate end 348. The mandrel may have various angles or surfaces as desired to increase strength of the mandrel 314 in axial and radial directions. The presence of the mandrel 314 may provide the tool with the ability to hold pressure and linear forces during setting or plugging operations.

The mandrel 314 may be sufficient in length, such that the mandrel may extend through a length of tool (or tool body) (202, FIG. 2B). The mandrel 314 may be a solid body. In other aspects, the mandrel 314 may include a flowpath or bore 350 formed therethrough (e.g., an axial bore). There may be a flowpath or bore 350, for example an axial bore, that extends through the entire mandrel 314, with openings at both the proximate end 348 and oppositely at its distal end (e.g., 246, FIG. 2D). Accordingly, the mandrel 314 may have an inner bore surface 347, which may include one or more threaded surfaces formed thereon. The inner bore surface 347 may be a uniform inner diameter, or have variance (one portion of the inner bore surface 347 having a different inner diameter than another), such as shown.

The end(s) 348 etc. of the mandrel 314 may include internal or external (or both) threaded portions. As may be desired, the mandrel 314 may have internal threads within the bore 350 configured to receive a mechanical or wireline setting tool, adapter, etc. (not shown here). For example, there may be a first set of threads configured for coupling the mandrel 314 with corresponding threads of another component (e.g., adapter 252, FIG. 2B). In an embodiment, the first set of threads may be shear threads. In an embodiment, application of a load to the mandrel 314 may be sufficient enough to shear the first set of threads. Although not necessary, the use of shear threads may eliminate the need for a separate shear ring or pin, and may provide for shearing the mandrel 314 from the workstring 312.

The mandrel 314 may have a neck or transition portion 349, such that the mandrel may have variation with its outer diameter. In an embodiment, the mandrel 314 may have a first outer diameter that is greater than a second outer diameter. Conventional mandrel components are configured with shoulders (i.e., a surface angle of about 90 degrees) that result in components prone to direct shearing and failure. In contrast, embodiments of the disclosure may include the transition portion 349 configured with an angled transition surface. A transition surface angle may be about 10 to about 50 degrees with respect to the tool (or tool component) axis 358.

The transition portion 349 may withstand radial forces upon compression of the tool components, thus sharing the load. That is, upon compression the bearing plate (or sleeve) 383 and mandrel 314, the forces are not oriented in just a shear direction. The ability to share load(s) among components means the components do not have to be as large, resulting in an overall smaller tool size.

The mandrel 314 may have a seat shoulder 386 disposed therein. In some embodiments, the seat 386 may be a separate component, while in other embodiments the seat 386 may be formed integral with the mandrel 314. The seat shoulder 386 may be formed within the bore 350 at the proximate end 348 (and thus be formed on inner bore surface 347). The seat 386 may be configured to mate with an obstruction, such as the seat assembly 385.

Figure 3A:
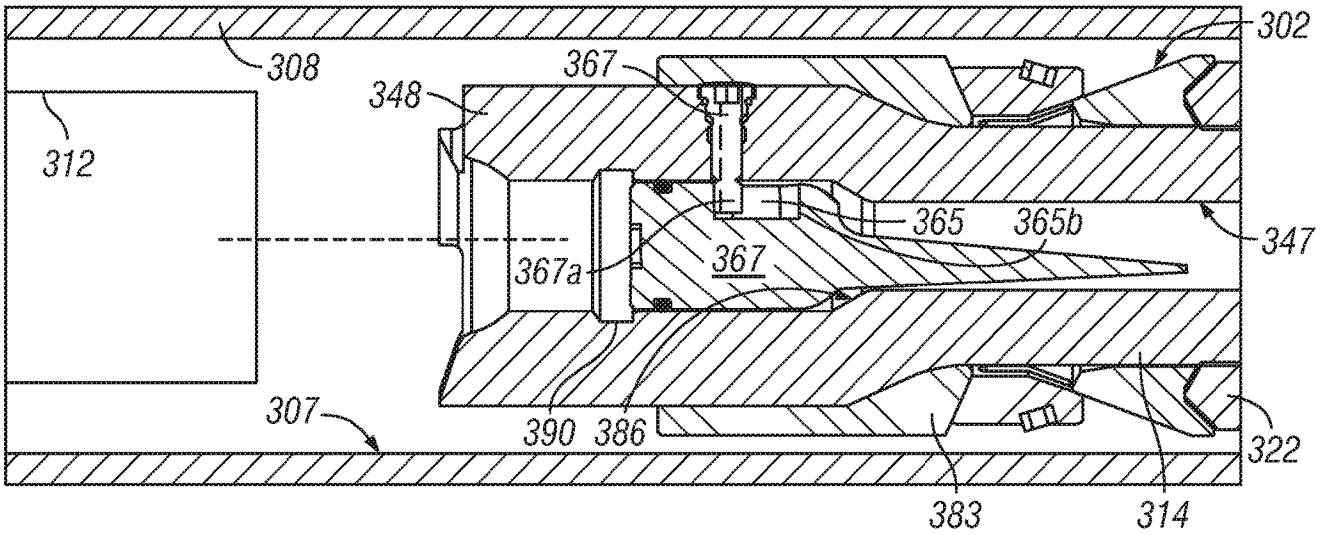
FIG. 3A shows a longitudinal side cross-sectional view of a mandrel end configured with a movable seat in a first position usable with a downhole tool according to embodiments of the disclosure.
Figure 3B:
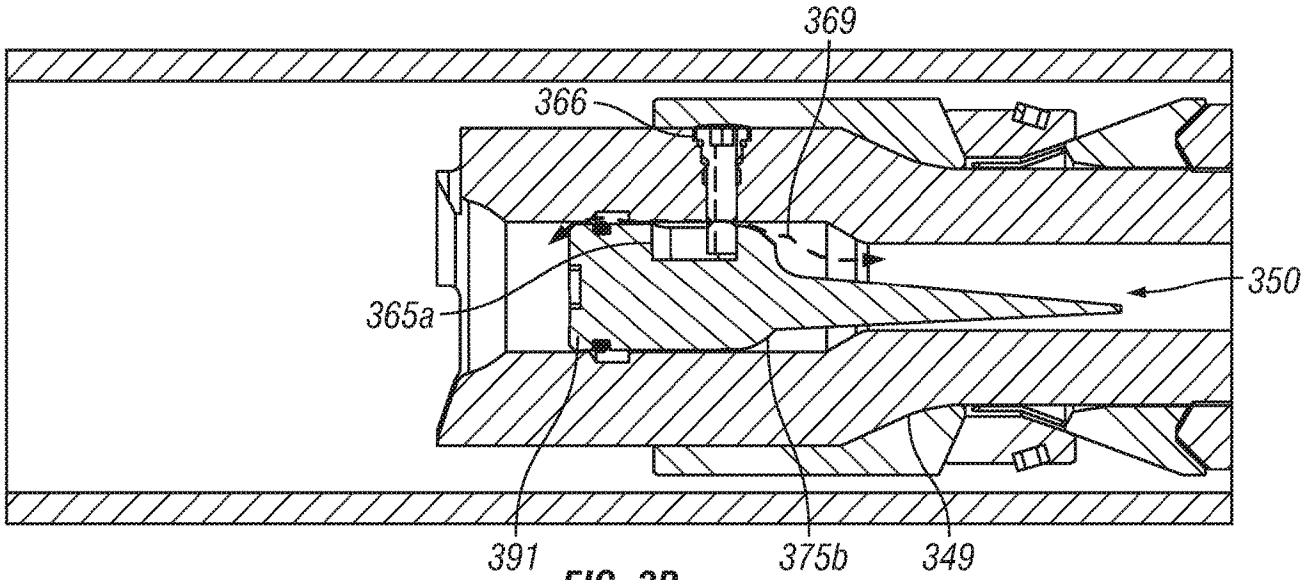
FIG. 3B shows a longitudinal side cross-sectional view of the movable seat of FIG. 3A in a second position according to embodiments of the disclosure.
Figure 3C:
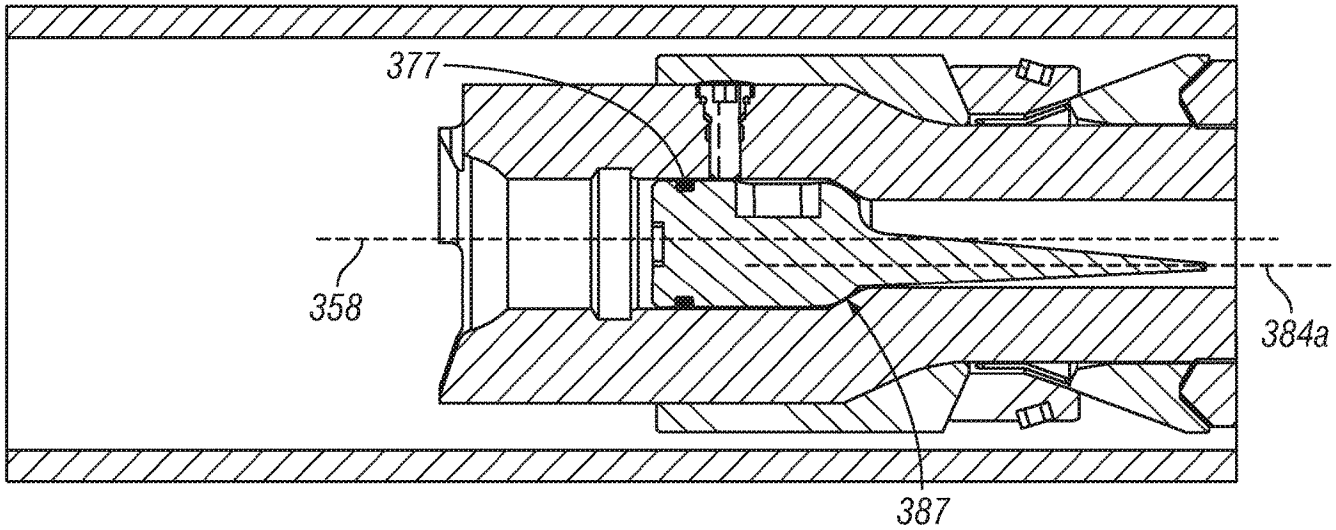
FIG. 3C shows a longitudinal side cross-sectional view of the movable seat of FIG. 3A in another or intermediate position according to embodiments of the disclosure.
Figure 3D:
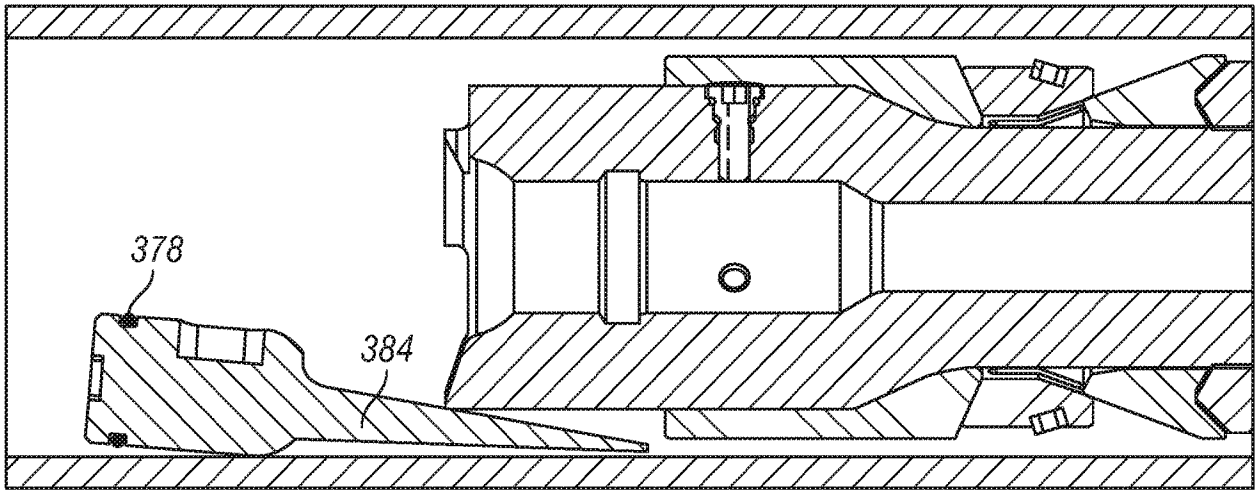
FIG. 3D shows a longitudinal cross-sectional view of the moveable seat of FIG. 3A in third or dislodged position according to embodiments of the disclosure.

As mentioned, FIG. 3A illustrates a first or run-in position of the tool 302. As shown, there may be a retainer pin 367 disposed in a retainer pin slot 366 formed in the mandrel 314. The pin 367 may have a pin end 367*a* that extends out sufficiently into the bore 350 in order to engage a pin end slot 365 formed in the seat assembly 385. The first position of the tool 302 may correspond synonymously to the first position of the seat assembly 385.

FIG. 3B illustrates a second or intermediate position of the seat assembly 385 of the tool 302. The second position may have a range of positions, and need not be static like a moment-in-time drawing would show. At this point, it may be the case that a pressure imbalance occurs up or downstream of the tool 302. For example, if the workstring 312 is pulled (at least partially) out of the tubular 308, a suction or swab effect may result in a pull on the seat assembly 385. Although the seat assembly 385 may at first be sealingly engaged within the bore 350 and against bore surface 347 (e.g., seal 377 shown sealingly and movingly engaged thereagainst) such that no flow occurs, the seat assembly 385 may move as a result of the pull. The translating length of travel of the seat assembly 385 while in the bore 350 depends on the configuration of the pin end 367*a* and the pin in slot 365, with the difference discernable here between FIGS. 3A and 3B. The first position may include the pin 367 (or end 367*a*) engaged with upper shoulder surface 365*a*, and the second position may include the pin 367 (or end 367*a*) engaged with the lower shoulder surface 365*b*.

Once the seat assembly 385 moves from a first or run-in position of FIG. 3A to another or intermediate position of FIG. 3B, a flowpath 369 may be established through the downhole tool 302 that facilitates equalization of pressure or wellbore fluids F. The flow path 369 may result in fluid communication from either side of the seat 385 via one or more channels or slots (not shown here) within the seat assembly 385. In addition or the alternative, moving the seat assembly 385 far enough may allow for the assembly 385 to adequately disengage from the surface (via expansion groove 390). As shown by flow path 369, and as would be apparent to one of skill, there may be sufficient clearance between surfaces, regardless of whether the scale of the drawing in FIG. 3B shows or not. In this intermediate position resistance to the workstring may be mitigated or alleviated.

As may be understood, the seat assembly 385 may be movable back and forth between the positions shown in FIGS. 3A and 3B via how the retainer pin 367 retains the assembly 385 in either direction via upper and lower shoulder surfaces 365*a*, 365*b* of slot 365. This may result in the ability of the seat assembly 385 to 'float' or translate within the bore 350 (which may be with some amount of resistance or drag via member 377 engaging bore surface 347).

Pressure above the tool 302 may urge the seat assembly 385 back to the position of FIG. 3A; for example, in the event another tool or operation does not work properly (e.g., perf gun misfire), the workstring 312 may be removed, and then a pump used to increase pressure into the tubular 308 and re-seat the assembly 385 or urge back toward the first position.

The pressure may be increased above a pre-determined break point or range associated with the retainer pin 367. The break point or range may be in excess of about 1,000 psi. In embodiments, the break point may be about 2,500 psi to about 3,500 psi, or as otherwise determined by the number of retainer pins 367 used. When the pressure exceeds the break point, the end of the retainer pin 367*a* may be sheared or broken off, and the seat assembly 385 now move into engagement with the seat shoulder 386. This may be seen by way of example of the contact point 387 shown in FIG. 3C. FIG. 3C shows the assembly 385 may have another position as part of the range of second positions. In this position, the tool 302 may be sufficiently obstructed so that an uphole operation may commence, such as fracing.

As the seat assembly 385 may no longer be restrained or held in place by the restrainer pin 367, the seat assembly 385 is freely movable. To unplug the tool 302, the well may be opened, and natural formation pressure from below the tool (usually in a range of about 50 psi to about 400 psi) may unseat and dislodge the assembly 385 from the tool 302. FIG. 3D shows the seat assembly 385 may be moved to a final or third (sometimes dislodged, etc.) position. This position may include the seat assembly 385 completely removed or dislodged from the bore 350. As this point the bore 350 may be fully open and readily accommodates (bi-directional) flow F through the downhole tool 302.

It may be problematic if a main body 391 of the seat assembly re-enters the bore 350 and blocks flow. As such the seat assembly 385 may be configured with an extension piece, such as a wedge tip or tang 384 extending out from the body 391. The tip 384 may be eccentric and/or intentionally imbalanced to facilitate a bias of falling or moving against the wellbore 380. As shown, the downhole tool 302 may have a generally central axis 358, whereas tip axis 384*a* may be offset therefrom. The tip 384 may have a wider tip width at its initial extension point away from the body, that converges to a narrower tip width at its end (e.g., such as from a downward lateral viewpoint). Moreover, the tip 384 may have a larger tip thickness at its initial extension point away from the body that converges to a narrower thickness at this end (akin to a pointed end).

The wedge tip 384 may be configured to engage between the outer surface of the mandrel end 348 and the tubular inner surface 307, which may help keep the seat 385 out of the way. The seat assembly 385 may also be configured with a weight slot (not shown here), which may have a weight disposed therein. This may result in a weighted or 'nose-heavy' seat configuration that may help keep or direct the seat (via gravity or the like) on the bottom of the tubular 308.

With the seat 385 out of the bore 350 in the third or final position, a new obstruction, such as a frac ball, may be flowed down and into the tool 302 to provide pressure isolation and hold pressure for any subsequent uphole frac operation or otherwise.

Figure 4A:
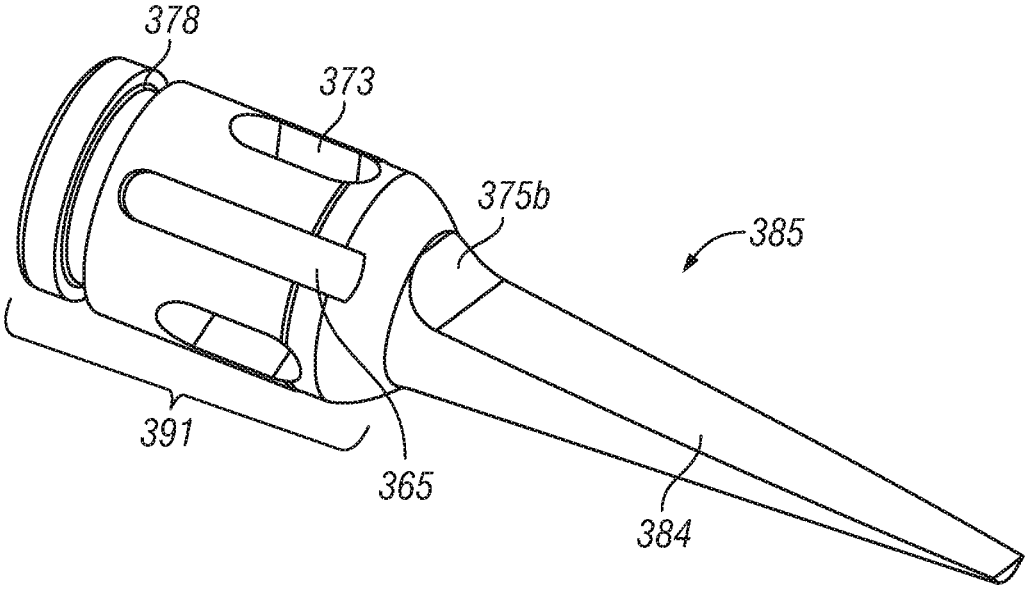
FIG. 4A shows an isometric view of a pump out seat assembly according to embodiments of the disclosure.
Figure 4B:
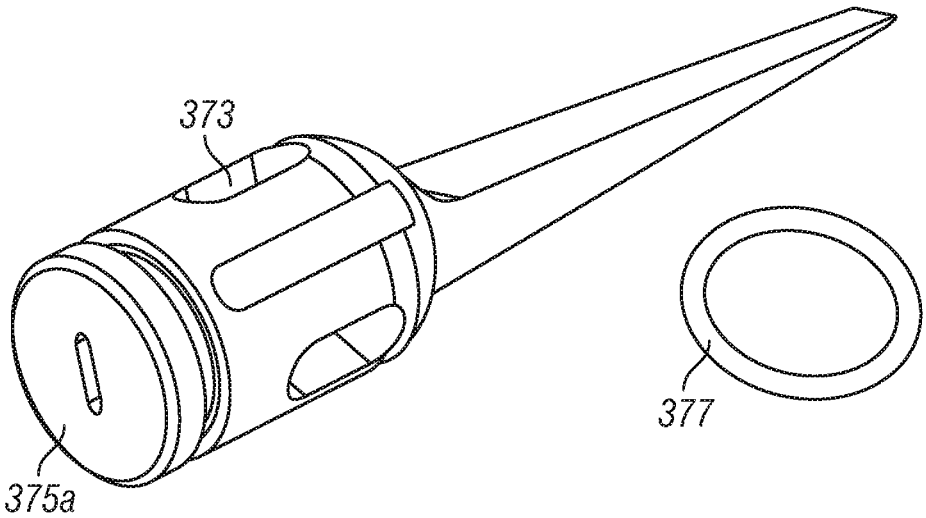
FIG. 4B shows a rotated isometric view of the pump out seat assembly of FIG. 4A according to embodiments of the disclosure.

Referring now to FIGS. 4A and 4B, an isometric view of a pump out seat assembly and a rotated isometric view of the pump out seat assembly, respectively, according to embodiments of the disclosure, are shown.

FIGS. 4A and 4B together show the pump out seat assembly 385 may include a main body 391, which may be asymmetrical in nature with one or more grooves, holes, receptacles, or slots 365, 373, 378, etc. disposed therein. The main body 391 may have an extension connected therewith, such as a wedge tip or tang 384. The seat assembly 385 (or main body 391) may have a first or upper surface 375*a* and a second or lower surface 375*b*. Although described or shown as 'wedge', other configurations may be possible (for example duck bill or the like), with the general purpose associated with 'wedging' part of the seat 385 between a downhole tool (302, FIG. 3D) and a surrounding tubular (308). Although not shown here the wedge tip 384 may have one or more recesses or receptacles, which may have a denser/heavier material filled in (for example, a heavier metal object may be glued or welded therein).

To aid engagement with a downhole tool, there may be a seal member or o-ring 377 disposed in the seal member groove 378. The movement of the seat assembly 385 may be longitudinal back and forth between a first position and another position via the longitudinal nature of the pin end slot 365.

Figure 5A:
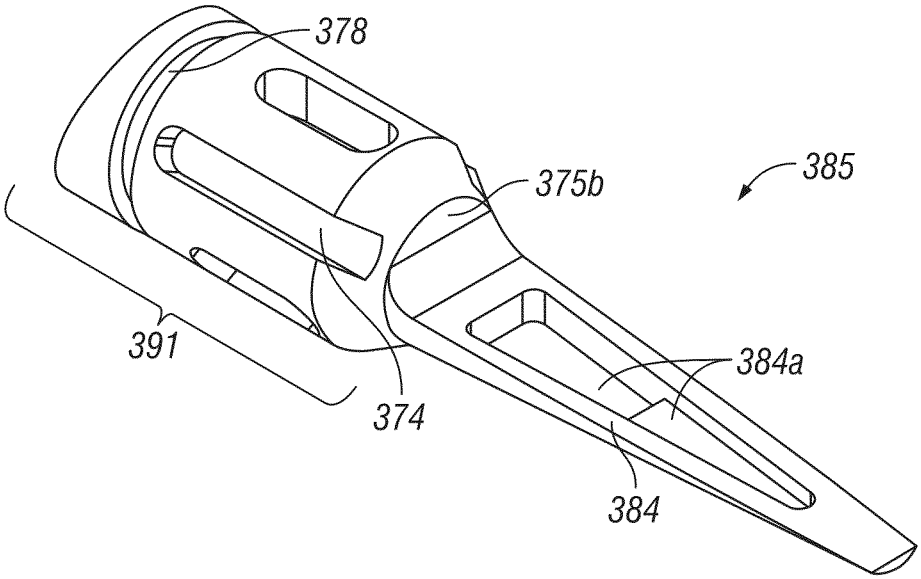
FIG. 5A shows an isometric view of an alternate pump out seat assembly according to embodiments of the disclosure.
Figure 5B:
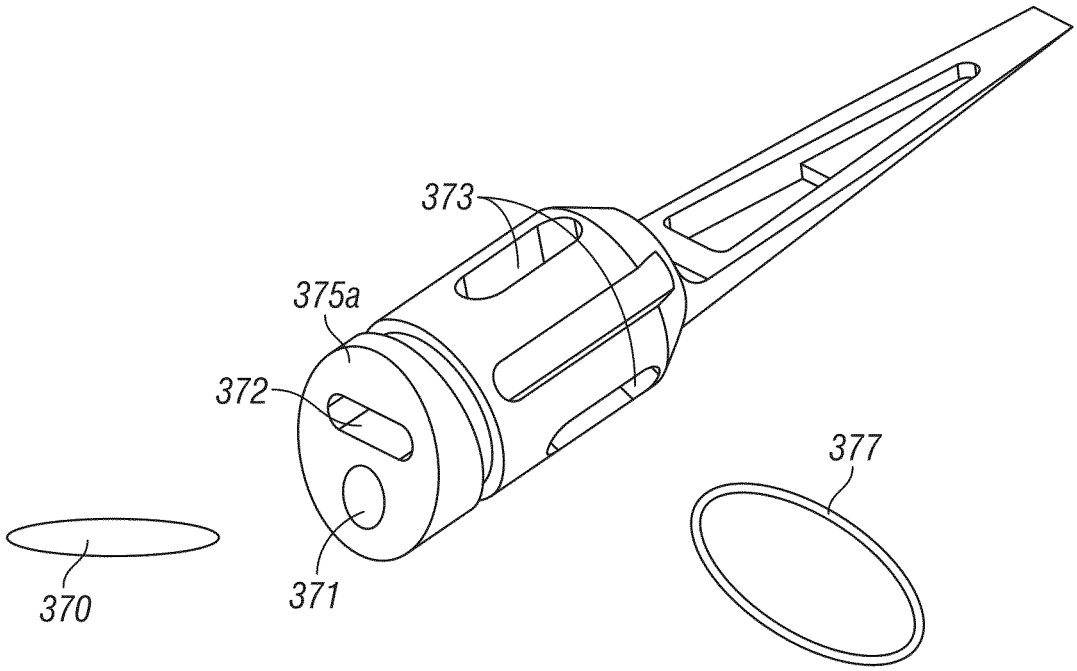
FIG. 5B shows a rotated isometric view of the pump out seat assembly of FIG. 5A according to embodiments of the disclosure.

Referring now to FIGS. 5A and 5B, an isometric view of a variant pump out seat assembly and a rotated isometric view of the pump out seat assembly, respectively, according to embodiments of the disclosure, are shown.

FIGS. 5A and 5B together show the pump out seat assembly 385 may include a main body 391, which may be asymmetrical in nature with one or more grooves, holes, receptacles, or slots 371, 372, 373, 374, 378, etc. disposed therein. The main body 391 may have an extension connected therewith, such as a wedge tip 384. Although described or shown as 'wedge', other configurations may be possible. The wedge tip 384 may have one or more recesses or receptacles 384*a*, which may have a denser/heavier material filled in (for example, a heavier metal object may be glued or welded therein).

To aid engagement with a downhole tool, there may be a seal member or o-ring 377 disposed in the seal member groove 378. To additionally or alternatively aid weighting of the seat 385, there may be a weighted member 370 disposed within the weight receptacle 371.

Regardless of examples shown or described, any pump out seat assembly of any embodiments herein may be used with any downhole tool of the disclosure, or any other downhole tool that may be useful in a pressure isolation situation.

Any tip may have a wider tip width at its initial extension point away from the body, that converges to a narrower tip width at its end (e.g., such as from a downward lateral viewpoint). Additionally or alternatively, the tip may have a larger tip thickness at its initial extension point away from the body that converges to a narrower thickness at this end (akin to a pointed end).

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole tool comprising:

a mandrel configured with a bore and a respective seat formed on an inner bore surface;

a pump out seat disposed within the bore in a first position;

wherein the pump out seat is movable between the first position and an other position, wherein the pump out seat comprises a seal member, wherein in the first position the seal member is sealingly engaged with the inner bore surface thus preventing flow through the bore, wherein in a second position the seal member is no longer engaged with the inner bore surface thereby facilitating fluid flow through the bore, wherein the first position comprises the pump out seat not engaged on the respective seat, and wherein the other position comprises the pump out seat dislodged from the bore.

2. The downhole tool of claim 1, wherein the pump out seat comprises at least one wedge tip, wherein the downhole tool has a central axis and the wedge tip as a tip axis, and wherein the central axis and the tip axis are offset.

3. The downhole tool of claim 1, wherein the downhole tool is a frac plug, and wherein at least one component of the downhole tool is made of a reactive material.

4. The downhole tool of claim 1, wherein the pump out seat comprises a main body having first end, and a second end configured with a wedge tip extending therefrom.

5. The downhole tool of claim 1, wherein the second position comprises a shoulder surface of the pump out seat engaged with the respective seat of the bore.

6. The downhole tool of claim 5, wherein shearing of a retainer pin allows the pump out seat to move to the second position.

7. A downhole tool comprising:

a mandrel configured with a bore and a respective seat formed on an inner bore surface;

a pump out seat disposed within the bore in a first position, the pump out seat comprising a seal member configured to engage with the inner bore surface, wherein the pump out seat is movable between the first position, a second position, and a third position, wherein the first position comprises the pump out seat not engaged on the respective seat, and the seal member is sealingly engaged with the inner bore surface thus preventing any flow of fluid through the bore, wherein in the second position the seal member is no longer engaged with the inner bore surface thereby no longer preventing fluid flow through the bore, and wherein the third position comprises the pump out seat dislodged from the bore.

8. The downhole tool of claim 7, wherein the pump out seat comprises at least one wedge tip, wherein the downhole tool has a central axis and the wedge tip as a tip axis in parallel to the central axis, and wherein the central axis and the tip axis are offset.

9. The downhole tool of claim 8, wherein the downhole tool is a frac plug, and wherein at least one component of the downhole tool is made of a reactive material.

10. The downhole tool of claim 9, wherein shearing of a retainer pin allows the pump out seat to move to the second position.

11. A downhole tool comprising:

a mandrel configured with a bore and a respective seat formed on an inner bore surface;

a pump out seat disposed within the bore in a first position;

wherein the pump out seat is movable between the first position and an other position, wherein the first position comprises the pump out seat not engaged on the respective seat, wherein at least one component of the downhole tool is made of a reactive material, wherein the other position comprises the pump out seat dislodged from the bore wherein the pump out seat comprises at least one wedge tip, wherein in the first position the downhole tool has a central axis and the wedge tip as a tip axis, and wherein in the first position the central axis and the tip axis are offset.

12. The downhole tool of claim 11, wherein the downhole tool is a frac plug.

13. The downhole tool of claim 11, wherein the pump out seat comprises a seal member, wherein in the first position the seal member is sealingly engaged with the inner bore surface thus preventing flow through the bore, wherein in a second position the seal member is no longer engaged with the inner bore surface thereby facilitating fluid flow through the bore.

14. The downhole tool of claim 13, wherein the pump out seat comprises a sheared pressure down position whereby a shoulder surface of the pump out seat is engaged with the respective seat of the bore.

15. The downhole tool of claim 11, wherein the pump out seat comprises a sheared pressure down position whereby a shoulder surface of the pump out seat is engaged with the respective seat of the bore.

16. The downhole tool of claim 15, wherein shearing of a retainer pin allows the pump out seat to move to the sheared pressure down position.

17. The downhole tool of claim 15, wherein the downhole tool is a frac plug.

18. The downhole tool of claim 17, wherein the pump out seat comprises a seal member, and wherein in the first position the seal member is sealingly engaged with the inner bore surface.

19. The downhole tool of claim 11, wherein the downhole tool is a frac plug, and wherein at least one component of the downhole tool is made of a reactive material.

* * * * *